United States Patent [19]

Osgood

[11] Patent Number: 4,510,630

[45] Date of Patent: Apr. 16, 1985

[54] MINI-BIDET

[76] Inventor: R. W. Osgood, P.O. Box 1062, Cameron Park, Calif. 95682

[21] Appl. No.: 481,356

[22] Filed: Apr. 1, 1983

[51] Int. Cl.[3] ..... A61H 35/00; A47K 3/22

[52] U.S. Cl. ..... 4/443; 4/448; 4/420.1; 4/420.2; 4/420.4

[58] Field of Search ..... 4/443, 447, 448, 420.1, 4/420.2, 420.4, 420.5

[56] References Cited

U.S. PATENT DOCUMENTS

| | | | |
|---|---|---|---|
| 1,752,782 | 4/1930 | Burton | 4/448 |
| 2,852,782 | 9/1958 | Sundberg | 4/448 |
| 3,513,487 | 5/1970 | Palermo et al. | 4/420.4 |
| 3,882,864 | 5/1975 | Montgomery | 4/420.1 |
| 3,995,326 | 12/1976 | Umann | 4/420.2 |
| 4,000,742 | 1/1977 | DiGlacomo | 4/448 |
| 4,041,553 | 8/1977 | Sussman | 4/447 |
| 4,135,255 | 1/1979 | Menendez | 4/448 |
| 4,205,402 | 6/1980 | Miller | 4/447 |
| 4,383,339 | 5/1983 | Miller | 4/443 |

*Primary Examiner*—Henry K. Artis

*Attorney, Agent, or Firm*—Leonard Bloom

[57] ABSTRACT

A personal hygiene device comprising a hand-held mini-bidet to be used in conjunction with conventional bathroom facilities which taps the hot and cold water conduits associated with a bathroom sink, thereby providing a temperature supply of pressurized water to a bidet housing stored along side the toilet bowl, the housing having a spray nozzle selectively controlled by a depressable button on the bidet housing so that a spray of cleansing and soothing fluid can be precisely directed to target areas associated with personal hygiene.

19 Claims, 6 Drawing Figures

MINI-BIDET

BACKGROUND OF THE INVENTION

The device of the instant application relates generally to the field of hygienic devices, and more specifically to a miniature bidet to be used in conjunction with bathroom facilities.

The personal hygiene device known as the bidet is well known and utilized in other parts of the world, notably Europe. Although often known as a feminine hygiene device, the bidet is particularly well adapted for the cleansing of the rectal area as well as the genital area. For those who suffer with hemorrhoids or similar rectal tissue irritations, the conventional means of cleansing the rectal area, i.e., using tissue paper, can be excruciatingly painful. Furthermore, the well controlled and directed spray from a bidet provides a superior cleansing method and a more sanitary technique than the conventional tissue. Also, the gentle spray from the bidet allows thorough cleansing with maximum comfort. Therefore, it should be easily understood that a bidet provides an advantageous alternative to conventional methods for personal hygiene cleansing, not only for those with medical problems, but also for the public at large.

However, there are a number of problems associated with the installation and use of the bidet devices, which are quite prolific in the prior art. The following citations are the prior art of which applicant is aware that would appear to be germane to the patent process:

L. L. Farley, U.S. Pat. No. 1,818,388.
C. H. Berger, U.S. Pat. No. 3,425,066.
Colucci, U.S. Pat. No. 3,662,407.
Doran, U.S. Pat. No. 3,797,481.
DiGlacomo, U.S. Pat. No. 4,000,742.
Butterfield, U.S. Pat. No. 4,197,594.
Miller, U.S. Pat. No. 4,205,402.
Bader, et. al. U.S. Pat. No. 4,259,754.

The problem of installation is a major disadvantage in bidet apparatus designed to be retrofitted to be used in conjunction with conventional-type toilet facilities. It is often necessary in prior art devices to make complex adjustments to the plumbing in order to accommodate the bidet. For example, the patents to Colucci and DiGlacomo require intensive modifications to existing plumbing in order to install the devices according to those patents.

A further disadvantage with prior art devices exists in adjusting the direction, velocity, and temperature of the spray emanating from the bidet. In order to be completely effective the spray from the bidet must thoroughly cleanse the target area, which can only be accomplished by manipulating the spray head appropriately. Thus devices with unidirectional spray or minimal adjustment are inherently inferior, because they will not accomplish the required task of a thorough cleansing. For example, the patents to Farley, Miller, Bader, et. al., Butterfield, and Berger are all limited in maneuverability due to the structure and location of the bidet nozzle, which is severely limited in range and direction and often requires complex manipulation of the structural members of the device in order to address the problem. Furthermore, many of the devices just cited do not provide for adjustment of the velocity or the temperature of the spray, which is essential to the comfortable and efficient functioning of the device.

A further problem associated with many prior art bidet devices is the sanitary conditions of the device itself. If the bidet remains inside the toilet bowl, whether or not it is retracted to a storage position therein, it is subject to the contamination by the bio-organisms and/or chemicals contained therein. This situation may present a problem of infection or irritation to the user. For example, the patents to Butterfield, Miller, and Berger all provide bidets that are installed within the confines of the toilet bowl, thus having the attendant problems hereinabove delineated.

The remaining references further delineate the state-of-the-art as known to the applicant.

Therefore there exists a strong-felt yet unfulfilled need for the device according to the instant application which provides a mini-bidet unit that effectively overcomes prior art disadvantages since it is easily installed, hand-held so that the spray can be precisely directed, and further provides a means to adjust the water temperature of the spray. This is accomplished by tapping into the tubes beneath the bathroom sink which lead from the water supply shut-off valves to the faucet. The self-tapping saddle valves used permit hot and cold water to be mixed in proper proportion so that water temperature at the bidet is comfortably warm. The self-tapping connectors are operatively associated with flexible conduits which supply the bidet unit itself, which comprises a small hand-held housing stored alongside the toilet bowl in an appropriate holder, the hand-held housing and the spray nozzle associated therewith being manipulated by the user at the appropriate time. Depressing a button on the top of the housing opens a valve which allows the warm water to be sprayed from the nozzle area. After the user is finished the bidet unit is returned to its holder. Thus the problem associated with installation of the bidet unit is greatly reduced due to the fact that the device according to the instant application can be readily installed to existing plumbing conduits with very little effort. Furthermore, the problems associated with the direction, velocity, and temperature of the spray itself are eliminated by the instant device since the unit is hand-held and the velocity of the spray is controlled by the amount the button on the top of the housing is depressed.

The possible sanitary problem noted above is greatly alleviated by the instant device, since its storage position is outside the toilet bowl itself thereby distancing the unit from any possible contamination from extended placement inside the toilet bowl itself. Furthermore, the instant device is self-cleansing due to the fluid passing therethrough.

SUMMARY AND OBJECTS OF THE INVENTION

The present invention provides an easily installed, hand-held bidet unit which is used in conjunction with the fixtures of a conventional bathroom including the sink and toilet unit. The bidet according to the instant application is mounted and stored on the exterior of the toilet bowl and manually operated when needed by holding a small housing with a spray nozzle in the proper position then depressing a conveniently located button which proportionally releases an upwardly directed fine spray of water supplied from the plumbing conduits associated with the sink in the bathroom.

Accordingly, it is the primary object of the present invention to provide a novel personal hygiene device in which a small, hand-held bidet unit is employed to direct a temperate spray towards the anal or genital area to comfortably and thoroughly cleanse same.

It is a further object of the present invention to provide a novel personal hygiene device which is easily installed and retrofitted to present conventional bathroom facilities by clamping two self-tapping valves to existing plumbing conduits associated with a sink in the conventional bathroom. The temperature of the water which will emanate from the spray nozzle in the bidet unit is predetermined by the settings of the self-tapping saddle valves which meter the hot and cold water to the bidet from a mixing "tee."

It is still another object of the present invention to provide a novel personal hygiene device which is stored in a more sanitary position outside the toilet bowl so that when not in use there is a reduced likelihood of contamination from infectous bacteria which may become associated with a bidet unit deployed within the confines of the toilet bowl. Furthermore, the instant device is readily disassembled for easy cleaning to insure continued sanitary conditions.

It is still a further object of the present invention to provide a novel personal hygiene device which eliminates the need for dry cleansing the rectal area with tissue paper; a method which has proven to be less sanitary and more irritating.

It is still another object of the present invention to provide a novel personal hygiene device which greatly alleviates the fear and pain associated with bowel movements in those individuals who have harsh irritation of sensitive hemorrhoidal tissue. In fact, the device according to the instant application is not only cleansing but soothing to those individuals who suffer from hemorrhoidal discomfort.

It is yet another object of the present invention to provide a novel personal hygiene device with a spray tube that can be easily exchanged for another nozzle configuration for other purposes such as a douching attachment. Furthermore, different spray tubes can be provided with different nozzle apertures to control the density and gauge of the spray itself.

It is still yet another object of the present invention to provide a novel personal hygiene device which can be used with either hand and from the front or the rear so that a maximum maneuverability and convenience is achieved with a minimum amount of apparatus.

It is yet a further object of the present invention to provide a novel personal hygiene device to be which is particularly well adapted to be used in conjunction with a toilet having associated therewith a bio-degradable septic tank or closed treatment system such as found in RVs and boats. Since no toilet tissue is used which has to be disposed of in the septic tank, the processes of the bio-degradation can proceed without the interference of the tissue paper which clogs and interferes with the process. Furthermore, any toilet tissue which is used to pat dry is sanitary enough to be disposed of in a wastebasket, therefore no toilet paper or other foreign matter need be released into a septic system.

It is yet another object of the present invention to provide a personal hygiene device to be used in conjunction with a conventional commode which is simple to make, cost effective to manufacture, easy to retrofit, and lends itself well to mass production techniques.

These and other objects will become apparent when considered in light of the following specifications and the appended drawing figures.

DESCRIPTION OF THE PREFERRED EMBODIMENT

Figure 1:
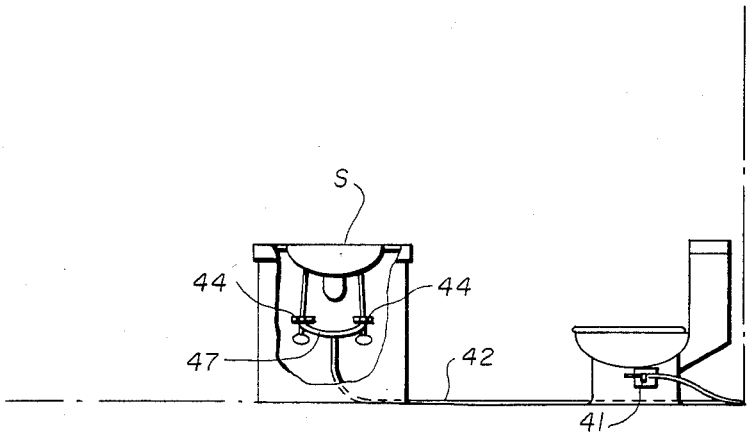
FIG. 1 is a side view of a conventional toilet facility showing the sink and the toilet bowl and the interconnection of the device according to the instant application therebetween.

Referring now the drawing figures in detail wherein like reference numerals represent like parts throughout the several figures, reference numeral 10 refers generally to the housing associated with the instant device which has a forward aperture 11 and a rear aperture 12 which is operatively associated with a conventional plumbing fitting 13. On the top of the housing 10 is an upwardly protruding valve button 14 which actuates the spray and controls its force according to the amount of pressure applied. The bottom surface of the housing 10 has a downwardly extending, rounded protuberance 15 which provides a convenient purchase area for hand grasping of the entire housing.

The housing 10 has a centrally disposed inner cavity 16 which has an upwardly facing open portion adapted to complementarily receive the button 14 which is pivotedly mounted on a pin 17. A forwardly extending cylindrical passageway extends from the inner cavity 16 to the forward aperture 11 and is adapted to slidably receive a spray tube 20. The housing 10 is further provided with a rear passageway 19 which operatively communicates with the central cavity 16 on one end and which on an opposed end thereof terminates at the rear aperture 12. The rear passageway 19 is adapted to receive the valving mechanism, to be delineated hereinafter.

Figure 3:
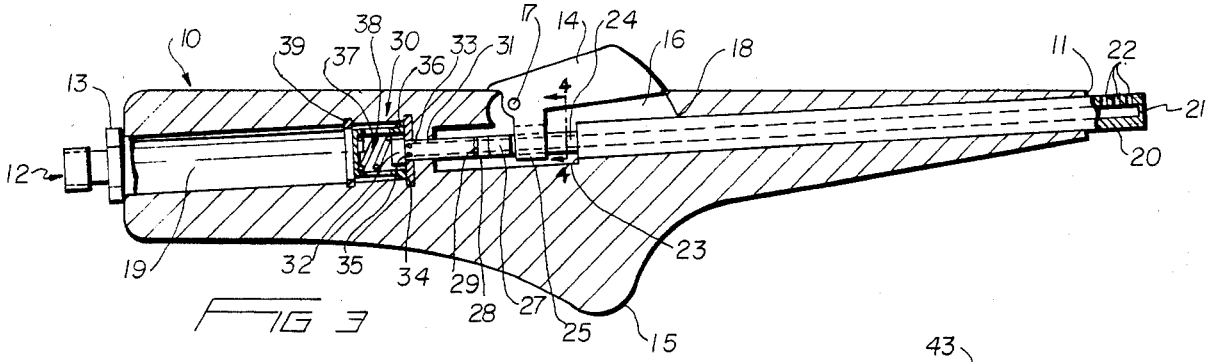
FIG. 3 is a sectional view of that which is shown in FIG. 2 taken along lines 3—3.
Figure 4:
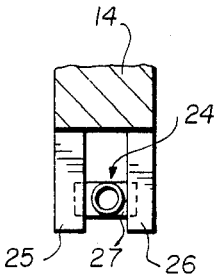
FIGS. 4 and 4*a* are a partial sectional view of that which is shown in FIG. 3 taken along lines 4—4.
Figure 4A:
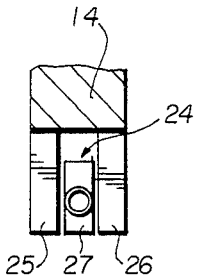

Referring again to FIG. 3, the spray tube 20 is a hollow cylindrical tube with a closed end 21 which extends beyond the housing through aperture 11 enough distance to expose a series of upwardly directed orifices 22 which act as a nozzle to spray the pressurized water directed thereto. The end of the cylindrical section of the spray terminates at a stepped down shoulder 23 at which point the spray tube becomes a hollow square section 24 which extends rearwardly between the downwardly extending forks 25 and 26 of the spray actuation button 14. As best shown in FIG. 4, the spray tube square section 24 expands outwardly into a rectangular section shoulder portion 27 directly behind the push button forks 25 and 26, directly thereafter the spray tube 20 returns to a cylindrical cross section 28 and terminates at a pliant washer 29 which has a centrally disposed aperture to allow fluid to pass therethrough. Thus the entire spray tube 20 can be removed by rotating the tube 90° (as shown in FIG. 4*a*) which allows the shoulder portion 27 to pass freely between the downwardly extending forks 25 and 26 thereafter the tube being extracted forwardly until completely removed through aperture 11. The removal and installation of the spray tube 20 is similar to that of a bayonet-type fastener.

It should be noted that the spray tube 20 in alternate embodiments may be adapted and structurally changed at the delivery end to perform the functions of a douche implement, an enema device, or the like without departing from the spirit of the invention.

Figure 2:
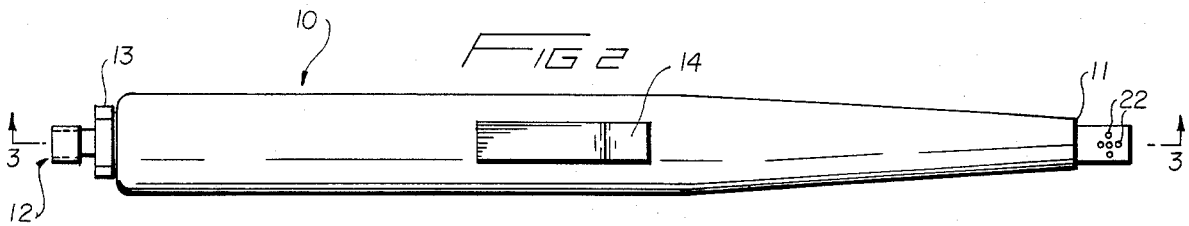
FIG. 2 is a top view of the hand-held housing associated with the instant device.

The valve mechanism, generally referred to by reference numeral 30 (FIG. 2), comprises a forward, hollow, tube section forming a valve stem 31 with a forward open end that abutts and seals with the pliant washer 29 and an opposed end which is stepped up into a large cylindrical section and completely occludes the tubular cross section. An annular groove 33 directly adjacent to plug end 32 carries therein a pliable washer 34. The groove 33 has on an inner portion thereof a series of orifices 35 which are adapted to receive pressurized water and communicate same through the spray tube 20. The plug end 32 of the valve stem 31 rides within a cage 36 and is biased forwardly by a spring 37 thereby maintaining a first closed position whereby the washer 34 completely occludes the forward lip of the cage 36 and further occludes orifices 35. The cage 36 has peripherally disposed slots 38 to allow pressurized fluid to pass therethrough to the interior of the cage. The rear of the cage is positioned and secured by a sir-clip 39 which similarly abutts a water supply conduit 13 which defines the rear passage way 19.

The valve mechanism 30 is actuated by depressing the spray button 14 which forces the forks 25 and 26 rearwardly engaging the shoulder 27 which translates horizontally, driving the tubular valve stem 31 horizontally from the first closed position to a second open position in which pressurized water passes through the slots 38 in the cage 36 around the plug end 32 to the exposed orifices 35 which receive the pressurized water and translate same through the spray tube 20 to the forward orifices 22 from which a fine spray emanates. The amount and velocity of the spray is directly proportional to the amount the button 14 is depressed, thus providing a very responsive means of control of the spray emanating from the spray tube 20.

Figure 5:
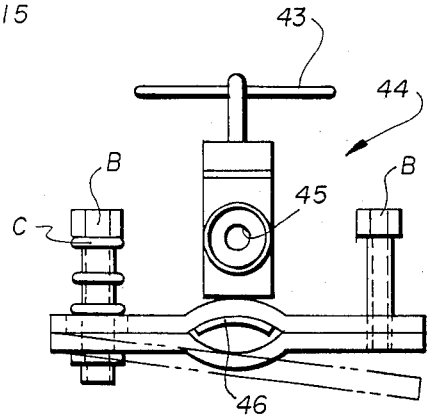
FIG. 5 is a side view of a saddle valve which is used to tap the plumbing conduit.

As shown in FIG. 1, the housing 10 is stored in a holder 41 attached to a sidewall of a conventional toilet in a position to provide easy access. A flexible conduit 42 is connected between the bidet housing 10 and the water conduit pipes of a conventional bathroom sink. Conventional saddle valves generally referred to by reference numeral 44 (FIG. 5), are employed to tap into the water conduits beneath the sink S. The saddle valve 44 depicted in FIG. 5 has been modified by addition of a spring C and other minor changes which permit it to be more easily installed on the water lines beneath the sink. The modification allows the valve 44 to be self-positioning on the tubing to permit one handed installation, if necessary. Rotating the T-section 43 of the saddle valve 44 forces a hollow needle projection (not shown) to pierce the sidewall of the water conduit thereby providing a source of water through orifice 45 operatively connected through a mixing "tee" 47 to the flexible supply conduit 42. A rubber seal 46 prevents leakage and clamping is provided by bolt-type fasteners B. Both a hot and cold water conduit are thus tapped to provide a source of warm water which insures the greatest comfort for the use of the device.

In use and operation, one first turns on the hot water tap and runs water in the bathroom sink for a few seconds to bring hot water into the water line, then turns off the tap. This assures that the water supply to the bidet will be comfortably warm. Thus assuring proper water temperature, the user may then occupy the toilet seat to answer nature's call. Thereafter the bidet housing is grasped and held in the proper position from either the front or the rear to disseminate a cleansing and soothing spray of temperate water to the targeted areas. Since the housing can be manipulated by hand the spray can be easily well directed thereby taking full advantage of the benefits of a bidet device. The volume and velocity of the water thus employed are selectively controlled by depressing the spray button 14 more or less accordingly. When finished, the self-rinsing bidet housing is returned to the storage position in the holder 41 and the user may pat dry with a fold of toilet tissue.

The foregoing provides a description of a preferred embodiment, however, it should be noted that numerous structural changes and modifications may be resorted to without departing from the spirit of the invention.

What is claimed is:

1. In a bathroom facility including a toilet having a seat and further having a sidewall beneath the seat, the facility further including a sink having a conventional source of pressurized water, a bidet apparatus comprising in combination:

a hand-held housing, holder means attached to the sidewall of the toilet for storing the housing, whereby the bidet apparatus is convenient to the user, yet outside the toilet bowl and relatively free from contamination, the housing having contained therein, a spray tube, the spray tube being slidably removable from the housing and readily replaced with an interchangeable spray tube, whereby the bidet apparatus may perform the functions of a douche implement, enema device or the like, valving means and actuation means operatively associated with said valving means, a flexible conduit means connected on one end to, and interposed between, said housing and attachment means on an opposed end of said conduit means, whereby said attachment means taps the source of pressurized water supplying same to said housing through said conduit means.

2. In a facility having a receptacle with a seat and a source of pressurized fluid, a bidet apparatus comprising in combination:

a hand-held housing having contained therein, a detachable spray tube, valving means and actuation means operatively associated with said valving means, a flexible conduit means connected on one end to, and interposed between, said housing and attachment means on an opposed end of said conduit means, whereby said attachment means taps the source of pressurized fluid supplying same to said housing through said conduit means, wherein said housing has a centrally disposed cavity with an open top, a forward extending passageway through said housing terminating in a forward aperture, a rear passageway extending through said housing terminating in a rear aperture, and a formed protuberance on a bottom surface of said housing to provide a purchase area to help achieve a firm grip on said housing.

3. The apparatus of claim 2, wherein said housing and its contents are self-cleaning due to the fluids passing therethrough.

4. The apparatus of claim 2, wherein said spray tube detachably contained within said housing comprises a hollow, elongated conduit closed at a forward end, with a series of discharge orifices on an upper surface of said tube proximate said closed end and extending beyond said housing through said forward aperture, said spray conduit extending rearwardly therefrom through said forward passageway to said central cavity, said spray conduit having a stepped down medial portion with transverse shoulders proximate thereto, and said spray conduit terminating in an open and abutting a pliant washer seal.

5. The apparatus of claim 4, wherein said actuation means comprises a spray actuation button pivotally mounted within said central cavity and extending upwardly through said open top for manual access, said button having depending from a bottom surface thereof two spaced apart fork members which operatively engage said shoulders on said spray tube so that depressing said button horizontally translates said spray tube actuating said valving means whereby the pressurized fluid is proportionally supplied according to the manual pressure applied to said spray button, so that the force of the spray emanating from said orifices in said spray tube is precisely controlled.

6. The apparatus of claim 5, wherein said valving means comprises a hollow valve stem with an open end abutting said open end of said spray tube, an annular groove proximate to a stepped up plug portion on an opposed end thereof, said groove carrying a pliant washer overlying and occluding a series of orifices contained within said groove, said washer further occluding an open end of a valve cage, said cage secured within said rear passage having a closed end, peripheral slots, and a spring contained therein biasing said valve stem in a closed position, whereby depressing said spray button translates said valve stem horizontally, controllably deforming said pliant washer allowing pressurized fluid to flow through said orifices in said groove to said spray.

7. The apparatus of claim 6, wherein said flexible conduit means attaches to said housing at said rear aperture supplying pressurized fluid to said housing, whereby said housing can be hand-held and easily maneuvered with either hand to a variety of positions allowing a user to precisely direct a spray emanating therefrom.

8. The apparatus of claim 7, wherein said attachment means comprises at least one saddle valve which attaches to and taps the source of pressurized fluid and supplies same to said flexible conduit, whereby said attachment means can be easily installed to existing fluid conduits.

9. The apparatus of claim 8, wherein said attachment means further includes two saddle valves, a first saddle valve tapping a cold water pipe and a second saddle valve tapping a hot water pipe, both pipes associated with a bathroom sink proximate to a toilet facility having said bidet apparatus connected thereto by said flexible conduit, whereby the temperature of the water supplied to said bidet apparatus can be assured by first running water into the sink until a comfortable water temperature is achieved.

10. The apparatus of claim 9, wherein said housing is retained in a holder attached in an easily accessible position to a lower exterior wall of a toilet bowl, whereby said housing is stored in a position distant from the normal path of human discharge materials thereby preventing inadvertent contamination of said housing by same or any other contaminants or irritants associated with the interior of a toilet bowl.

11. The apparatus of claim 10, wherein said spray tube is easily detached and installed by rotating same substantially 90 degrees, thereby allowing said shoulders on said spray tube to pass between said forks depending from said spray button, thereafter extracting or installing said spray tube through said forward passage.

12. The apparatus of claim 11, wherein said spray tube has an extended forward end formed to allow same to function for the purpose of an enema or a douche.

13. A bidet apparatus adapted to be removably installed in a bathroom facility having a sink supplied with hot and cold water conduits and a toilet with a bowl and a seat comprising in combination:

a hand-held housing having contained therein, a slidably removable spray tube extending from said housing with orifices on an upper surface thereof, valving means to controllably supply water to said spray tube, actuation means to variably control said valving means and flexible conduit means attached to said housing to supply said housing with hot and cold water, attachment means connected to said flexible conduit means, said attachment means connected to and tapping both the hot and cold water conduits, holder means attached to a lower exterior wall of the toilet bowl, below the seat, thereby retaining said housing in a storage position on the outside of the toilet bowl to prevent contamination, whereby said housing can be easily maneuvered to a variety of positions according to need in which a user can first adjust the temperature of the water to be discharged prior to use, thereafter controlling the direction and velocity of the discharged water to cleanse and soothe perineal areas.

14. The apparatus of claim 13 wherein said bidet can be easily installed in any existing bathroom facility having accessible hot and cold water pipes without major modifications.

15. The apparatus of claim 14 wherein said bidet can be installed in conjunction with a closed septic facility, such as those associated with boats and recreational vehicles, to eliminate or greatly reduce the use of toilet tissue which is not amenable to deposit in a closed septic system.

16. The apparatus of claim 15 wherein said housing is stored in an unobtrusive position on the exterior of a toilet bowl, whereby said housing does not interfere with use of the toilet when said bidet apparatus is not employed.

17. The apparatus of claim 16 wherein said spray tube has orifices of varying size and configuration, whereby the spray emanating therefrom can be adjusted from a mist to a stream.

18. The apparatus of claim 17 wherein said spray tube and said valving means have interposed therebetween sealing means in the form of a pliant washer.

19. A mini bidet, comprising a housing including a hand grip portion and further including a forward portion provided with a cylindrical passageway therein, a hollow spray tube slidably received within the passageway, the spray tube including a forward portion projecting beyond the housing and having outlet orifices formed thereon externally of the housing, the spray tube further including a rearward portion having a shoulder formed thereon, a valve button pivotably mounted on the housing and having a pair of forks straddling the spray tube forwardly of the shoulder, whereby the spray tube may be rotated by substantially ninety degrees such that the shoulder clears the pair of forks, intermediately thereof, and such that the spray tube may be slidably withdrawn from the housing, the housing further having a rearward passageway adapted to be connected to a pressurized fluid source, a hollow valve stem slidably received in the housing between the rearward passageway and the spray tube, the forward end of the valve stem abutting the end of spray tube, a plug on the rearward end of the valve stem, the valve stem having orifices formed thereon forwardly of the plug, sealing means between the plug on the valve stem and the rearward passageway in the housing, radially of the orifices, and resilient means constantly urging the plug and hence the valve stem forwardly of the housing, whereby when the valve button is actuated, the forks engage the shoulder on the spray tube and slide the spray tube and valve stem rearwardly in the housing, thereby unseating the plug on the valve stem, and means in the rearward passageway allowing fluid flow through the orifices in the valve stem, and thence through the hollow spray tube to the outlet orifices externally of the housing.

* * * * *